US008754022B2

(12) United States Patent
Zhang et al.

(10) Patent No.: US 8,754,022 B2
(45) Date of Patent: Jun. 17, 2014

(54) GARBAGE DISPOSAL CLEANING POUCH COMPRISING ENCAPSULATED BICARBONATE AND METHODS OF USE

(75) Inventors: Wenyu Zhang, Pleasanton, CA (US); Elizabeth L. Donald, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 13/493,685

(22) Filed: Jun. 11, 2012

(65) Prior Publication Data

US 2013/0327678 A1 Dec. 12, 2013

(51) Int. Cl.
*C11D 3/10* (2006.01)
*C11D 7/26* (2006.01)

(52) U.S. Cl.
USPC ..... 510/194; 510/101; 510/117; 510/296; 510/349; 510/434; 510/441; 510/477; 510/478; 510/509

(58) Field of Classification Search
USPC ..... 510/101, 117, 194, 296, 349, 434, 441, 510/477, 478, 509
See application file for complete search history.

(56) References Cited

U.S. PATENT DOCUMENTS

| | | | | |
|---|---|---|---|---|
| 4,414,130 | A * | 11/1983 | Cheng | 510/532 |
| 4,619,710 | A * | 10/1986 | Kuenn et al. | 134/22.17 |
| 4,664,836 | A * | 5/1987 | Taylor et al. | 510/196 |
| 5,417,963 | A | 5/1995 | Murphy et al. | |
| 5,482,702 | A | 1/1996 | Murphy et al. | |
| 5,585,093 | A | 12/1996 | Murphy | |
| 5,629,035 | A | 5/1997 | Miskewitz | |
| 6,397,862 | B1 * | 6/2002 | DeSenna et al. | 134/22.1 |
| 6,465,413 | B1 | 10/2002 | Hinton | |
| 6,486,116 | B1 | 11/2002 | Hinton | |
| 6,506,713 | B1 | 1/2003 | Slavtcheff et al. | |
| 7,053,039 | B2 | 5/2006 | Burt et al. | |
| 2001/0003738 | A1 | 6/2001 | Wise | |
| 2002/0128165 | A1 * | 9/2002 | Baker et al. | 510/309 |
| 2003/0080150 | A1 * | 5/2003 | Cowan et al. | 222/107 |
| 2003/0092590 | A1 * | 5/2003 | Dasque et al. | 510/296 |
| 2004/0116317 | A1 | 6/2004 | Burt et al. | |
| 2005/0079993 | A1 * | 4/2005 | Caswell et al. | 510/515 |
| 2009/0165228 | A1 * | 7/2009 | Kilkenny et al. | 15/104.94 |
| 2011/0142968 | A1 * | 6/2011 | Tuchinsky | 424/733 |

* cited by examiner

*Primary Examiner* — Charles Boyer
(74) *Attorney, Agent, or Firm* — Erin Collins

(57) ABSTRACT

This invention relates to compositions and methods to provide an effervescent garbage disposal cleaner. The compositions are contained in a water-soluble film and include encapsulated technologies to isolate ingredients that are sensitive to temperature and humidity fluctuations, and are also prone to react with each other, which would result in comprising the overall product performance.

20 Claims, 5 Drawing Sheets

GARBAGE DISPOSAL CLEANING POUCH COMPRISING ENCAPSULATED BICARBONATE AND METHODS OF USE

BACKGROUND OF THE INVENTION

1. Field of the Invention

The present invention relates to compositions to clean a garbage disposal and the like. The present invention relates to a non-liquid, effervescent composition for cleaning/sanitizing a garbage disposal. The composition is packaged in a water-soluble film and includes encapsulation technologies to isolate ingredients that are sensitive to temperature and humidity fluctuations, and are also prone to react with each other 2. Background and Relevant Art Garbage disposals are commonly found in household sinks, commercial businesses, institutional establishments and the like to dispose of food scraps. A typical garbage disposal is attached to a drain opening formed in a sink, for example, a kitchen sink. The disposal is cup like with walls and a bottom portion that includes rotating blades. Food scraps and tap water are inserted into the disposal. Once the disposal has been activated, the blades rotate at very fast rpms and work to grind and pulverize the food. The pulverized food particles are eventually flushed into a sewer or septic system.

A garbage disposal is convenient to make cleaning up after meals a breeze. However, the garbage disposal can contain mold, bacteria and other food particles that cause unpleasant odors. Odors, bacteria, mold and the like proliferate on the rotating blades and on the walls of the disposal. Thus, cleaning or sanitizing the disposal must be accomplished with a composition that maintains contact with the walls and the rotating blades, whilst the composition must not prematurely be flushed out before the composition has had time to be efficacious.

Liquids are commonly employed to clean garbage disposals. However, almost all liquids have the disadvantage that they are easily flushed down the disposal if the disposal is activated during the cleaning process. Solid tablets are also commonly employed. Tablets have the disadvantage of dissolving concerns, such as incomplete and/or slow dissolution, and handling issues (ie., user has to touch the tablet).

The present invention is a powdered composition packaged in a water-soluble film. The powdered composition comprises particles of encapsulated alkali bicarbonate, encapsulated fragrance, an acid, and a surfactant. Solutions to sanitize or clean a garbage disposal with a powdered composition in a pouch and including an alkali bicarbonate, fragrance, acid and a surfactant are proposed. When the acid and bicarbonate come into contact with water in the disposal unit, carbon dioxide gas is released. The carbon dioxide gas acts with the surfactants and the grinding action of the disposal to build a foam and expand and fill the interior portion of the disposal. This acid/base reaction provides a mechanism for maintaining foam in the chamber to provide contact time with the walls of the chamber and the rotating blades to effectively clean and sanitize the disposal and drain.

One disadvantage of using a powder that includes an alkaline material mixed with an acid is premature decomposition. This occurs because alkaline solution formed on the surface of the bicarbonate reacts with the acidic component(s). The bicarbonate is very hygroscopic and a disadvantage of using a powder that includes a hygroscopic agent is that it will cake when exposed to high humidity or high temperature. Once the composition has become caked, moisture has penetrated the composition and the reaction between the components has prematurely started. The result is a composition that is difficult to dissolve and has lost its effectiveness (ie., because the reaction of the agents has already begun). Indeed, if the components in the composition react prematurely, a consumer may notice little to no foaming performance.

For example, U.S. Pat. No. 4,619,710 to Kuenn et al, describes a disposal cleaner containing a surfactant, an alkali carbonate and an acid, and is herein incorporated by reference. Keunn describes a powder packaged in a water soluble, biodegradable disposable film, which in turn must be wrapped in a foil pouch to prevent moisture damage. The foil pouch would be opened by a consumer and the entire water soluble pouch containing the composition is dropped into the disposal. The Keunn pouch has the drawback that it must be packaged in a secondary package to protect it and the cleaning composition from humidity and high temperature.

In view of the current state of the art of garbage disposal cleaners/sanitizers, there is a need for a powdered product that is ready to use for the consumer (ie., no measuring or pre-dissolving step is required), effectively cleans the walls and the blades by utilizing the grinding action of the disposal and is environmentally friendly and inexpensive because it doesn't require secondary packaging to maintain stability.

SUMMARY OF THE INVENTION

The present inventors have found that when combining a water soluble encapsulated bicarbonate and water soluble encapsulated fragrance together in a water soluble pouch, the composition is surprisingly stable at high humidity and high temperature.

In one embodiment, a water soluble pouch for cleaning a garbage disposal and includes a solid composition comprising, an encapsulated bicarbonate, a surfactant, an acid selected from the group consisting of citric acid, malic acid, adipic acid and oxalic acid, an encapsulated fragrance; and the pouch is made of a polymer and is formed into a water soluble film, wherein the pouch and composition are stable at a storage parameter selected from humidity of about 50% to 95% and a temperature of about 60° F. to 150° F. The present invention provides that the acid may be present in the range of about 5% to 75% active weight.

In one embodiment, the bicarbonate particle size is about 15-250 μm and the fragrance particle size is between about 40-75 μm. The fragrance particle size may be between about 55-60 μm. The fragrance may be encapsulated in a starch matrix with a loading ratio of fragrance to starch of about 1:1 ratio. The bicarbonate may be encapsulated in a starch matrix with a loading ratio of bicarbonate to starch of about 7:3. The encapsulated bicarbonate may be present in the range of about 25-55% active weight of the composition. The bicarbonate may be sodium or potassium bicarbonate.

In one embodiment, the surfactant may be selected from the group consisting of anionic, nonionic, amphoteric, zwitterionic surfactants and mixtures thereof. In one embodiment of the invention, the surfactant may be selected from the group consisting of alkyl and alkylaryl sulfates and sulfonates having preferably 8 to 18 carbons in the alkyl group, which may be straight or branched chain. In another embodiment, the surfactant may be selected from the group consisting of sodium lauryl sulfate and sodium dodecylbenzene sulfonate. The surfactant may be present in the range of about 1 to 30% active weight.

In one embodiment, the present invention provides that the film is made from a polymer selected from the group consisting of polyvinyl alcohol (PVA), polyacrylates, water-soluble acrylate copolymers, methylcellulose, carboxymethylcellulose and mixtures thereof. The film may have a thickness of about 40 to 100 μm.

In one embodiment, the present invention provides that the fragrance is present in the range of about 1 to 20% active weight. The fragrance may be present in the range of about 5 to 15% active weight. The fragrance may be water-soluble and does not react with the alkali metal bicarbonate.

In one embodiment, the present invention provides that a secondary, protective packaging is not necessary to maintain stability of the composition during conditions selected from high temperature and high humidity. In the event that any secondary packaging is used to house the water soluble pouches, the secondary packaging does not need to be moisture or air impermeable to preserve the stability of the pouches. For example, a number of pouches may be packaged in a box or container, but unlike the prior art, the pouches do not need to be packaged individually in sealed foil or air-tight or water-tight plastic packages within a larger container.

The features and advantages of garbage disposal pouch of the present invention will become apparent from the following detailed description. It should be understood, however, that the detailed description and the specific examples while indicating preferred embodiments of the invention are given by way of illustration only, since various changes and modifications within the spirit and scope of the invention will become apparent to those skilled in the art from this detailed description.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
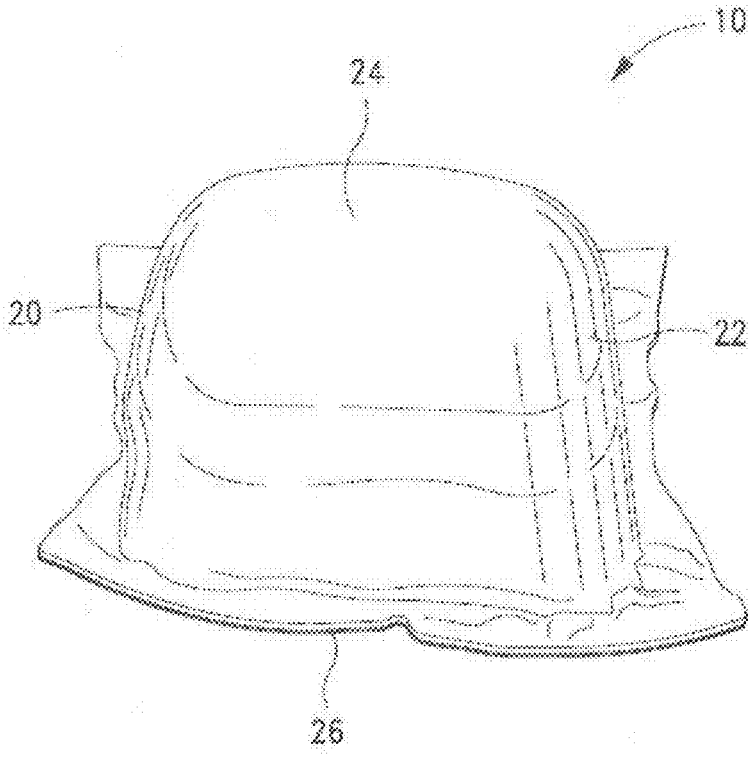
FIG. 1 is a top plan view of a water-soluble pouch package in accordance with the present invention.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

References herein to "one embodiment", "one aspect" or "one version" of the invention include one or more such embodiment, aspect or version, unless the context clearly dictates otherwise.

As used in this specification and the appended claims, the singular forms "a", "an", and "the" include plural referents unless the context clearly dictates otherwise.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("%'s") are in active weight percent (based on 100% active) of the active composition alone, unless otherwise indicated.

The teen "comprising", which is synonymous with "including," "containing," or "characterized by," is inclusive or open-ended and does not exclude additional, unrecited elements or method steps. See MPEP 2111.03. See, e.g., Mars Inc. v. H.J. Heinz Co., 377 F.3d 1369, 1376, 71. USPQ2d 1837, 1843 (Fed. Cir. 2004) ("like the term 'comprising,' the terms 'containing' and 'mixture' are open-ended."). *Invitrogen Corp. v. Biocrest Mfg., L.P.,* 327 F.3d 1364, 1368, 66 USPQ2d 1631, 1634 (Fed. Cir. 2003) ("The transition 'comprising' in a method claim indicates that the claim is open-ended and allows for additional steps."); Genentech, *Inc. v. Chiron Corp.,* 112 F.3d 495, 501, 42 USPQ2d 1608, 1613 (Fed. Cir. 1997) See MPEP 2111.03. ("Comprising" is a term of art used in claim language which means that the named elements are essential, but other elements may be added and still form a construct within the scope of the claim.); *Moleculon Research Corp. v. CBS, Inc.,* 793 F.2d 1261, 229 USPQ 805 (Fed. Cir. 1986); *In re Baxter,* 656 F.2d 679, 686, 210 USPQ 795, 803 (CCPA 1981); *Ex parte Davis,* 80 USPQ 448, 450 (Bd. App. 1948). See MPEP 2111.03.

The term "consisting essentially of" as used herein, limits the scope of a claim to the specified materials or steps "and those that do not materially affect the basic and novel characteristic(s)" of the claimed invention. *In re Herz,* 537 F.2d 549, 551-52, 190 USPQ 461, 463 (CCPA 1976) (emphasis in original). See MPEP 2111.03.

The term "consisting of" as used herein, limits the scope of a claim to the specified materials or steps, indicating that the claim or limitation to which it pertains is closed, not allowing for additional steps or materials.

All numbers expressing quantities of ingredients, constituents, reaction conditions, and so forth used in the specification and claims are to be understood as being modified in all instances by the term "about". Notwithstanding that the numerical ranges and parameters setting forth the broad scope of the subject matter presented herein are approximations, the numerical values set forth in the specific examples are reported as precisely as possible. Any numerical value, however, inherently contains certain errors necessarily resulting from the standard deviation found in their respective testing measurements."

As used herein, the term "disinfect" shall mean the elimination of many or all pathogenic microorganisms on surfaces with the exception of bacterial endospores.

As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant."

As used herein, the term "secondary, protective packaging" shall mean packaging required to prevent damage to the water soluble film pouch at high temperatures or high humidity. Examples of secondary, protective packaging include foil or metal wrap, cellulose film, cloth (e.g., cloth made from fibers or yarns comprising fiberglass, polyester, nylon, silk, cotton, poly-cotton or rayon), and nonwoven material and or any combination thereof or treated versions thereof. The protective, secondary packaging surrounds individual pouches in a sealed manner to prevent the pouches exposure to air, moisture, temperature fluxuations and other potentially damaging environmental conditions which would impact stability and efficacy of the pouches prior to use.

The water soluble pouch and cleaning composition for a garbage disposal is stable at high temperatures and high humidity. High temperatures are defined as at least 100° F.-120° F. High humidity is defined as greater than 50%. These are considered extreme conditions for consumer packaged goods during transportation and storage.

DETAILED DESCRIPTION OF INVENTION

This invention relates to compositions and methods to provide an effervescent garbage disposal cleaner. The compositions are packaged in a water-soluble film pouch and include encapsulated technologies to isolate ingredients that are sensitive to temperature and humidity fluctuations, and are also prone to react with each other, which would result in comprising the overall product performance.

Encapsulated Alkali Metal Bicarbonate

Solid state sodium bicarbonate starts to decompose at 158° F. However, even a trace amount of humidity can start the decomposition process at room temperature. One of the decomposition products is water, which can lead to premature reaction with other components. To overcome the problem of premature decomposition, the bicarbonate is incorporated into the composition in an encapsulated form. The inventors of the present invention surprisingly found that by encapsulating the bicarbonate in a water-soluble material, the encapsulation prevents the bicarbonate from reacting with any of the other ingredients in the composition and it protects the bicarbonate from reaction with external forces, such as humidity and temperature. Inclusion of an encapsulated fragrance further increases stability and a synergistic effect is realized when the encapsulated materials are packaged together in a water soluble pouch. This is unexpected, because the encapsulate(s) and pouch are water-soluble and, when considered individually, are all affected by humidity and high temperature. In one embodiment of the invention, alkali metal bicarbonates, particularly sodium and potassium bicarbonate are preferred.

The encapsulating material can be any water-soluble material that does not react with the alkali metal bicarbonate. In one embodiment, preferred materials include polysaccharides, for example simple sugars such as agarose, glucose, sucrose, fructose, galactose and starch. Gums, for example, xanthan, arabic, guar, gellan, acacia. Alginates, carageenans, pectin, stearic acid, silica gel. Polymers, for example, polyvinyl alcohol, polyethylene imine, polyethylene glycol, sodium polyoxyalkylene di-phosphonates. Proteins, for example, gelatin, casein, sodium caseinate, wheat gluten, whey protein isolate, sodium protein isolate, pea protein, corn protein (zein), sugar alcohols. Clays, for example, Na-bentonite and Ca-bentonite.

In one embodiment, the encapsulating material is starch. An exemplary bicarbonate in starch matrix is 5-95% weight-percent loading. For example, if you have a 100 g encapsulate, 5 g is the bicarbonate and 95 g is the matrix, and the loading is 5%. Preferably the loading ratio is 20-80% weight-percent loading, most preferably 30-70% weight-percent loading. The optimal blend of sodium bicarbonate to encapsulation matrix is 70% bicarbonate to 30% matrix by weight. Exemplary materials can be purchased from Encapsulation Technologies, Inc. and SprayTek. The encapsulation is manufactured via a traditional emulsion-spray-dry procedure. Exemplary processes are also described in U.S. Pat. No. 4,276,312, incorporated herein by reference. The encapsulate has a thickness of between 25-150 microns. Preferably, the thickness is 50-100 microns.

In one embodiment, the encapsulated bicarbonate is present in the range of about 5% to 75% active weight of the composition, preferably in the range of about 25-55% active weight of the composition, more preferably in the range of about 35-55% active weight. In an alternative embodiment, the bicarbonate is present in the range of about 45-55% active weight of the composition.

Foaming performance is affected by the particle size of the sodium bicarbonate.

Small particles have faster dissolution/reaction kinetics and create more foam. Large particles react slower and create less foam which equates to less cleaning action. However, the smaller the particle size, the more susceptible to heat decomposition the particles become. Small particles are easily solubilized, especially in the presence of water or humidity. In one embodiment, the bicarbonate particle size is about 15 to 250 μm and more preferably 15 to 100 μm. In another embodiment, the bicarbonate size is from about 20 μm to 70 μm.

Acid

In one embodiment, suitable acidic materials are medium-to-strong acids and in the solid-state. Preferably, the acid is selected from oxalic, malonic, succinic, glutaric, adipic, pimelic, suberic, azelaic, sebacic, maleic, fumaric, citric, sodium acid pyrophosphate, monosodium phosphate, disodium phosphate, sodium dihydrogen orthophosphate, and sodium/potassium bisulfate. More preferably, the acid is selected from citric acid, malic acid, adipic acid and oxalic acid.

In one embodiment, the acid is present in the range of about 5 to 75% active weight and preferably in a range of about 25 to 40% active weight.

Surfactants

The surfactant may be a single surfactant or a mixture of surfactants. In one embodiment, anionic, nonionic, amphoteric, zwitterionic surfactants and mixtures thereof are suitable in the present invention. Non-limiting examples of anionic surfactants include solid-state, water-soluble sulfate or sulfonate substituent group that has been base-neutralized, typically to provide an alkali metal (e.g., sodium or potassium) cation, including, for example: (1) alkyl and alkylaryl sulfates and sulfonates having preferably 8 to 18 carbons in the alkyl group, which may be straight or branched chain, e.g., sodium lauryl sulfate and sodium dodecylbenzene sulfonate; (2) alphaolefin aryl sulfonates preferably having from about 10 to 18 carbons in the olefin, e.g., sodium C14-16 olefin sulfonate; and (3) alkyl ether sulfates such as sodium lauryl ether sulfate. A preferred anionic surfactant is an alkyl sulfate, such as sodium lauryl sulfate.

In one embodiment, non-limiting examples of non-ionic surfactants include (1) fatty alcohol alkoxylates, especially the ethoxylates, wherein the alkyl group has from 8 to 22, preferably 12 to 18, carbons, and typically 6 to 15 moles of alkoxide per molecule; (2) fatty acid alkoxylates having from about 6 to about 15 moles of alkoxylate, especially the ethoxylate; (3) alkylphenoxy alkoxylates, especially the ethoxylates, containing 6 to 12 carbons, preferably octyl or nonyl, in the alkyl, and having about 5 to 25, preferably 5 to 15 moles alkylene oxide per molecule; (4) condensates of ethylene oxide with a hydrophobic base formed by condensation of propylene oxide with propylene glycol; (5) condensates of ethylene oxide with an amine or amide; (6) fatty amine oxides; (7) alkylolamides; and (8) low cloud point nonionic surfactants including, for example, ethoxylated-propoxylated alcohols. Preferred nonionic surfactants are the fatty alcohol ethoxylates.

In one embodiment, the surfactant is present in the range of about 1 to 30% active weight and preferably in a range of about 5 to 25% active weight.

Foam Boosters

The formulation can also include a foam booster to increase the amount or longevity of foam. In one embodiment, example foam boosters include, but are not limited to, fatty acid amides, alkoxylated fatty acid amides, fatty acid amides of alkanolamines, fatty acid amides of alkoxylated alkanolamines, and fatty acid amides of alkanolamide esters. Particles with diameters less than 1 micron can also be included to stabilize and enhance foams. Example particles include, but are not limited to, precipitated soaps, precipitated or fumed silica, aluminosilicates, clays, zeolites, metal silicates, metal carbonates, metal oxides, metal hydroxides, and various nanoparticles of carbon or other elements.

The composition may also contain surfactants as described above that increase the foam performance. Certain combinations of surfactants will synergistically increase the amount and longevity of the foam. In addition other ingredients such as water soluble polymers and viscosity modifiers can increase the amount or longevity of the foam.

In one embodiment, the foam booster is present in the range of about 1 to 30% active weight and preferably in a range of about 5 to 25% active weight.

Fragrance

Fragrance oil(s) may be incorporated to mask or eliminate odors caused by mold, bacteria or food particles left in the disposal. Some polar components in the fragrance oil can cause dissolution of other ingredients in the formula and thus, premature reaction. This can result in hardening, discoloration, off-gassing, and loss of efficacy of the overall composition.

In one embodiment, the fragrance is preferably volatile and encapsulated to isolate the fragrance until the time of use. Applicants surprising found that inclusion of an encapsulated fragrance increases the stability of the composition.

Suitable fragrances include any fragrance that does not react with the alkali metal bicarbonate. Exemplary fragrances include, but are not limited to, hydrocarbons, alcohols, aldehydes, ketones, esters, ethers, and mixtures thereof.

In one embodiment, the encapsulating material can be any water-soluble material that does not react with the fragrance. Preferred materials include polysaccharides, for example simple sugars such as agarose, glucose, sucrose, fructose, galactose and starch. Gums, for example, xanthan, arabic, guar, gellan, acacia. Alginates, carageenans, pectin, stearic acid, silica gel. Polymers, for example, polyvinyl alcohol, polyethylene imine, polyethylene glycol, sodium polyoxyalkylene di-phosphonates. Proteins, for example, gelatin, casein, sodium caseinate, wheat gluten, whey protein isolate, sodium protein isolate, pea protein, corn protein (zein), sugar alcohols. Clays, for example, Na-bentonite and Ca-bentonite.

In one embodiment, an exemplary fragrance encapsulating material is starch. An exemplary fragrance in starch matrix is 5-60% weight-percent loading. For example, if you have 100 g of encapsulate, 5 g is the fragrance and 95 g is the matrix, and the loading is 5%. In one embodiment, preferably the loading ratio is 10-50% weight-percent loading, most preferably 40-50% weight-percent loading. In one embodiment, the optimal blend of fragrance to encapsulation matrix is 50% bicarbonate to 50% matrix by weight.

Exemplary materials can be purchased from Firmenich, Pink Grapefruit 480282. Exemplary encapsulating materials are made by Akzo Nobel under the tradename ALCOSPHERE®. The size of the encapsulated particles is between about 40-75 μm, preferably 55-60 μm. Exemplary processes are described in U.S. Pat. No. 4,276,312, incorporated herein by reference.

In one embodiment, the encapsulated fragrance is present in the range of about 1 to 20% active weight and preferably in a range of about 5 to 15% active weight.

Abrasives

Abrasive particles may also be incorporated into the formula for added physical cleaning. In one embodiment, suitable abrasives are: quartz, pumice, pumicite, silica sand, calcium carbonate, calcium phosphate, zirconium silicate, and diatomaceous earth. Diatomaceous earth is preferred.

In one embodiment, the abrasive is present in the range of about 1 to 15% active weight.

Antimicrobial Agent

Antimicrobial agents may be included, alone or in combination, to add sanitizing or disinfecting power to the composition. In one embodiment, non-limiting examples of antimicrobial agents that can be included in the composition include isothiazolones, alkyl dimethyl ammonium chloride, triazines, 2-thiocyanomethylthio benzothiazol, methylene bis thiocyanate, acrolein, dodecylguanidine hydrochloride, chlorophenols, quaternary ammonium salts, gluteraldehyde, dithiocarbamates, 2-mercaptobenzothiazole, para-chloro-meta-xylenol, chlorohexidine, polyhexamethylene biguanide, n-halamines, triclosan, phospholipids, alpha hydroxyl acids, 2,2-dibromo-3-nitrilopropionamide, 2-bromo-2-nitro-1,3-propanediol, farnesol, iodine, bromine, biguanide compounds, chlorine dioxide, botanical oils (e.g., tee tree oil and rosemary oil), botanical extracts, benzalkonium chloride, peroxide, peroxides, chlorinated hydrocarbons, organometallics, halogen-releasing compounds, mercury compounds, metallic salts, pine oil, essential oils, organic sulfur compounds, iodine compounds, silver nitrate and other silver compounds, quaternary phosphate compounds, and/or phenolics, preferably, the antimicrobial agent is selected from calcium hypochlorite, quaternary ammonium salts, and percarbonates.

In one embodiment, the antimicrobial agent is present in the range of about 1 to 30% active weight and preferably in a range of about 5 to 25% active weight.

Water Soluble Pouch

The present invention provides a water-soluble pouch package that does not require complex packaging, and is much more economical and environmentally friendly than unit-dose products in packages that are not water soluble.

In one embodiment, preferred pouch materials are selected from polymers, copolymers or derivatives thereof, polyvinyl alcohols (PVA), polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatin, natural gums such as xanthum and carragum, glycerine, borax, sugars, proteins, acrylates, pasty surfactants (including but not limited to, betaines, block copolymers, etc.), polymers that adhere but also suspend dirt and soils, polysac-carides, polyols, adhesives using hydrogen bonding, PEGs, Pluronics®, cationic polymers—poly(DADMAC), chitosan; poly (Quats), Polyelectolyte Complexes (PECs), coacervates, modified cellulose (e.g. CMC, HPMC, HEMC, HPC), modified starch, (e.g. PEO, PPO, and block copolymers thereof), hydroxy alkyl acrylates, hydroxy alkyl methacrylates, alkyl or hydroxy alkyl ethers, vinyl esters, polyacrylic acid, Gantrez® (maleic anhydride/methylvinyl ether copolymers from ISP), Gafquat® (PVP/quat copolymer from ISP), plasticizers or tackifiers (e.g. PEO, PPO, polyhydric alcohols (glycerin, sorbitol, etc.), terpenes, and combinations thereof.

More preferred polymers are selected from PVA, polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof.

In one embodiment, the level of polymer in the pouch material, for example a PVA polymer, is at least 60% active weight. Preferably the polymer present in the film is from 60% to 100% active weight, more preferably 80-100% active weight. In some embodiments, the film is crosslinked to increase strength and flexibility of the film. Exemplary pouch materials are PVA films known under the tradename MonoDose®, and sold by Monosol US, and PVA films of corresponding solubility and deformability characteristics.

In another embodiment of the invention, the water-soluble film herein may comprise other additive ingredients than the polymer or polymer material. For example, it may be beneficial to add plasticizers, for example glycerol, ethylene glycol, diethyleneglycol, propylene glycol, propane diol, sorbitol and mixtures thereof, additional water, disintegrating aids, fillers, anti-foaming agents, emulsifying/dispersing agents, and/or antiblocking agents.

In one embodiment, such a film is preferably 10 to 200 μm thick, more preferably from 40 to 100 μm thick. A particularly suitable commercially available film is MonoSol, MonoDose®, 76 μm thick.

Article of Manufacture

In one exemplary embodiment of the invention, the construction of the pouch 10 is best illustrated in FIG. 1. The pouch 10 is a substantially square pocket made of a film of water-soluble material. The pouch may be constructed in any shape known in the art, such as a circle, star, rectangle, etc. The pouch 10 includes a left side 20, a right side 22, a top 24 and a bottom 26.

The sealed pouch can be made from any suitable method known in the art, including such processes as thermo-forming, vacuum-forming, heat sealing, solvent welding, and adhesive sealing (e.g., with use of a water-soluble adhesive) and those described in US20110186467 to Monosol, incorporated herein by reference.

One method to make a pouch material is to introduce the material to a mold and a vacuum is applied so that the pouch material is flush with the inner surface of the mould, thus forming a vacuum formed indent or niche in said pouch material. This is referred to as vacuum-forming. Another suitable method is thermo-forming. Thermo-forming typically involves the step of forming an open pouch in a mold under application of heat, which allows the pouch material to take on the shape of the mould.

The cleaning composition comprised by the pouch is contained and completely surrounded by the film of water soluble material. The cleaning composition is, thus separated from the outside environment by a barrier of the water soluble film. The pouch is suitable to hold the cleaning composition without allowing release of the composition prior to contact with water and/or when the garbage disposal is activated.

Optional Ingredients

Optional ingredients include, but are not limited to, wetting agents, dispersing agents, hydrotropes, solvents, polymers, rheology control agents, chelating agents, abrasives, colorants, anticorrosion agents and other functional additives.

Method of Using

In one exemplary embodiment of the invention, a consumer would start with an empty sink and the disposal off. Then a consumer would run a full stream of hot water for about 1 minute in the sink. The water flow is then reduced to a thin stream on the side of the sink. A pouch would be inserted in the disposal and the disposal would be activated. When the acid and bicarbonate come into contact with water in the disposal unit, carbon dioxide gas is released. The carbon dioxide gas acts with the surfactants and the grinding action of the disposal to build a foam and expand and fill the interior portion of the disposal. Foam may rise into the sink, or into both sinks if a double sink, and lasts about 1-2 minutes. The disposal is turned off when the foam completely retreats into the disposal. The remaining foam should be rinsed from the sides of the sink.

The pouch begins to dissolve once it comes into contact with water. Agitation from the disposal blades increases the dissolution process and enhances foam generation. Agitation also increases dissolution of the encapsulated bicarbonate and encapsulated fragrance. The fragrance oil is released once the encapsulate is dissolved.

EXAMPLES

The following examples will further illustrate the present invention. The compositions are made by combining the listed ingredients in the listed proportions (weight % unless otherwise specified). Example compositions 1 to 5 exemplify compositions according to the present invention but are not necessarily used to limit or otherwise define the scope of the present invention.

The Example Compositions presented below comprise the following:

TABLE 1

| Component | Comp. A | Comp. B | Comp. C | Comp. D | Detail |
|---|---|---|---|---|---|
| Sodium bicarbonate, encapsulated | 52% | | | 52% | USP grade 2, 70% loading. Spray-Tek, Inc.; 344 Cedar Avenue., Middlesex, NJ 08846 |
| Sodium bicarbonate, neat | | 39% | 39% | | |
| Citric acid | 30% | 30% | 30% | 30% | Anhydrous, fine. Tate & Lyle |
| Stepanol ME-Dry-sodium lauryl sulfate | 10% | 10% | 10% | 10% | Stepan |
| Fragrance, encapsulated | 8% | 8% | | | Pink grapefruit 480282, Firmenich, with Alcosphere |
| Fragrance, neat | | | 4% | 4% | Pink grapefruit 480282, Firmenich |

Example 1

Figure 2:
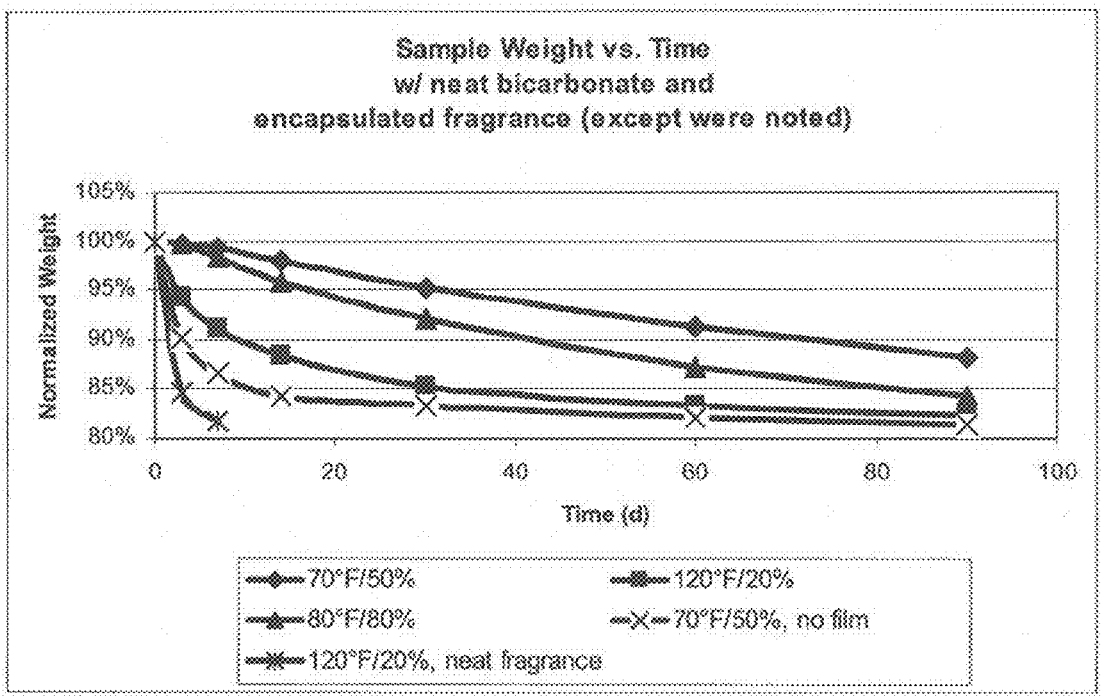
FIG. 2 is a graphical illustration of a compositional weight decrease vs. time (in days) for 5 samples that all include neat bicarbonate. The samples were taken at the reported temperature and humidity. The humidity is reported in the legend. For example, 70° F./50% means 70 degrees ° F. and 50% relative humidity (50% of the saturated humidity at 70° F.).

Results are presented in FIG. 2. Sample Weight vs. time (in days) for 5 samples that include neat bicarbonate and an encapsulated fragrance, except as noted. Samples were tested with inclusion of a water soluble film pouch, except as noted. The film used to make the pouches is commercially available film from MonoSol MonoDose®, at a thickness of 76 micrometers. Each pouch is filled with a Composition B or C (see Table 1) and is depicted in the graph with a corresponding symbol, for example ♦, ▲, ■, x, *. The test method is as follows: Prior to testing, all the pouches were individually weighed and were then kept in a vented polymeric package (to mimic actual shelf storage conditions), under indicated temperature and humidity. The sample was allowed to react/rest for the indicated amount of time (ie., 20 days, 40 days, etc) and reweighed. For sample X, the sample was placed directly in the vented polymeric package, as no soluble film pouch was provided.

Example 2

Figure 3:
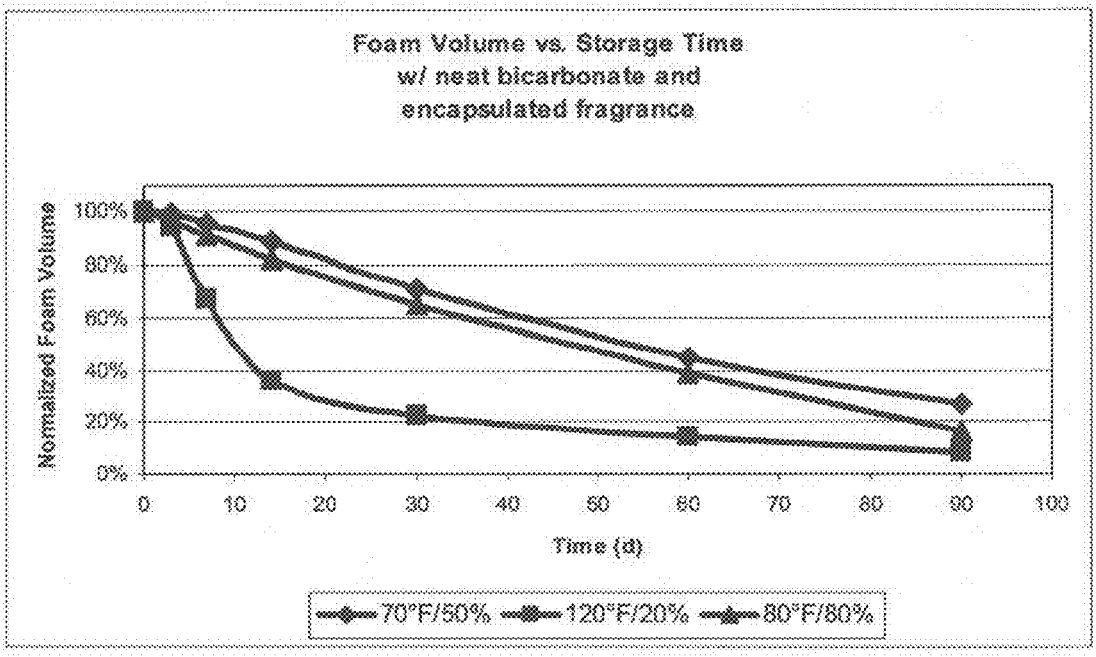
FIG. 3 is a graphical illustration of a compositional foam volume vs. time (in days) for 3 samples that all include neat bicarbonate. The samples were taken at the reported temperature and humidity. The humidity is reported in the legend. For example, 70° F./50% means 70 degrees ° F. and 50% relative humidity (50% of the saturated humidity at 70° F.).

Results are presented in FIG. 3. Sample foam volume vs. time (in days) for 3 samples that all correspond to Composition B in Table 1. The test method is as follows: Prior to testing, all the pouches were kept in a vented polymeric package (to mimic actual shelf storage conditions), under indicated temperature and humidity for the indicated period of time. A sample pouch was cut open and 0.50 g of powder product was weighed out and immediately added to the bottom of a 500-mL graduate cylinder with a magnetic stir bar. 50 mL of water was added to the graduated cylinder and swirled vigorously for 5 seconds to ensure mixing. The graduated cylinder was placed on a stir plate at the highest possible stir rate. The composition starts to foam when the water and powder product are thoroughly mixed. A volume reading is taken when the foam stops rising. Repeat the procedure 3 times from the same pouch. Use the mean foam volume.

Example 3

Figure 4:
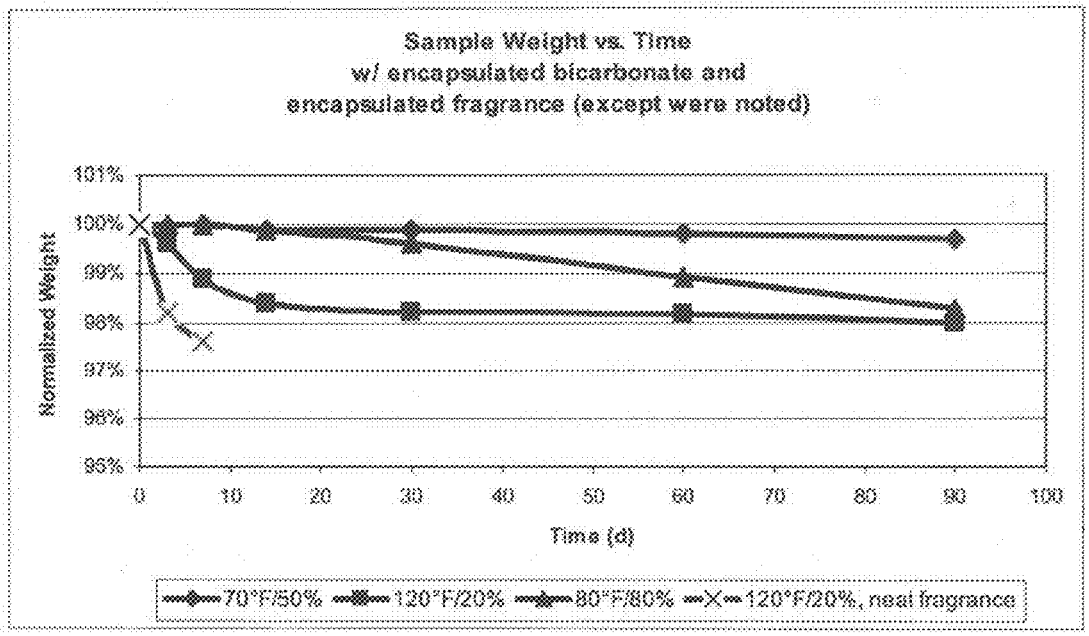
FIG. 4 is a graphical illustration of a compositional weight decrease vs. time (in days) for 4 samples that all include encapsulated bicarbonate. The samples were taken at the reported temperature and humidity. The humidity is reported in the legend. For example, 70° F./50% means 70 degrees ° F. and 50% relative humidity (50% of the saturated humidity at 70° F.).

Results are presented in FIG. 4. Sample Weight vs. time (in days) for 5 samples that include encapsulated bicarbonate and an encapsulated fragrance, except as noted. All samples include a water soluble film pouch. The film used to make the pouches is commercially available film from MonoSol, MonoDose®, film at a thickness of 76 μm. Each pouch is filled with a Composition A or D provided in the table above. The data sets for ♦, ▲, ■, correspond to Composition A in Table 1. The data set for x corresponds to Composition D in Table 1. The test method is the same as reported in Example 1.

Example 4

Figure 5:
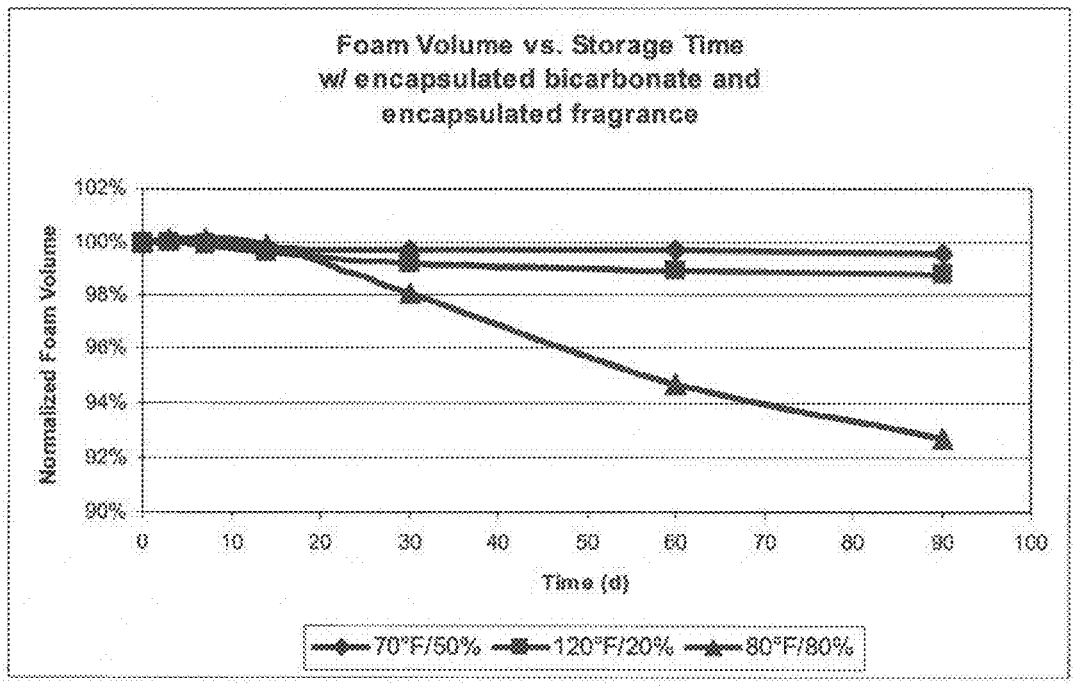
FIG. 5 is a graphical illustration of a compositional foam volume vs. time (in days) for 3 samples that all include encapsulated bicarbonate. The samples were taken at the reported temperature and humidity. The humidity is reported in the legend. For example, 70° F./50% means 70 degrees ° F. and 50% relative humidity (50% of the saturated humidity at 70° F.).

Results are presented in FIG. 5. Sample foam volume vs. time (in days) for 3 samples that all correspond to Composition A in Table 1. The test method is the same as reported in Example 2.

The above results clearly show the improved stability in the compositions that include the synergistic combination of the encapsulated technology with the water soluble film pouch.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

We claim:

1. A water soluble pouch for cleaning a garbage disposal consisting of:

A. a solid composition consisting essentially of:

a. greater than 25% to about 55% active weight encapsulated bicarbonate;

b. about 1 to 25% active by weight of a surfactant selected from the group consisting of: anionic surfactants and nonionic surfactants and any mixtures or combinations thereof;

c. an acid selected from the group consisting of citric acid, malic acid, adipic acid and oxalic acid;

d. an encapsulated fragrance; and

B. a water soluble polymer film shaped into said pouch which contains said solid composition;

wherein said pouch and composition are stable at a storage parameter selected from humidity of about 50% to 95% and a temperature of about 60° F. to 150° F.

2. The pouch of claim 1, wherein the bicarbonate particle size is about 15 μm to 100 μm.

3. The pouch of claim 1, wherein the fragrance particle size is between about 45-55 μm.

4. The pouch of claim 1, wherein the fragrance is encapsulated in a starch matrix with a loading ratio of fragrance to starch of about 1:1.

5. The pouch of claim 1, wherein the bicarbonate is encapsulated in a starch matrix with a loading ratio of bicarbonate to starch of about 7:3.

6. The pouch of claim 1, wherein encapsulated bicarbonate is present in the range of about 25-55% active weight of the composition.

7. The pouch of claim 1, wherein the surfactant is selected from the group consisting of: anionic, nonionic, amphoteric, zwitterionic surfactants and any mixtures thereof.

8. The pouch of claim 7, wherein the surfactant is selected from the group consisting of: alkyl and alkylaryl sulfates and sulfonates having preferably 8 to 18 carbons in the alkyl group, which may be straight or branched chain and any mixtures thereof.

9. The pouch of claim 8, wherein the surfactant is selected from the group consisting of: sodium lauryl sulfate and sodium dodecylbenzene sulfonate and any mixtures thereof.

10. The pouch of claim 1, wherein the surfactant is present in the range of about 1 to 30% active weight.

11. The pouch of claim 1, wherein the acid is citric acid.

12. The pouch of claim 1, wherein the acid is present in the range of about 5% to 75% active weight.

13. The pouch of claim 1, wherein the film is made from a polymer selected from the group consisting of polyvinyl alcohol (PVA), polyacrylates, water-soluble acrylate copolymers, methylcellulose, carboxymethylcellulose and mixtures thereof.

14. The pouch of claim 1, wherein the film has a thickness of about 40 to 100 μm.

15. The pouch of claim 1, wherein the fragrance is present in the range of about 1% to 20% active weight.

16. The pouch of claim 1, wherein the fragrance is present in the range of about 5% to 15% active weight.

17. The pouch of claim 1, wherein the fragrance is water-soluble and does not react with the alkali metal bicarbonate.

18. The pouch of claim 1, wherein said water soluble pouch is not contained in an air or moisture impermeable secondary, protective packaging.

19. A water soluble pouch for cleaning a garbage disposal consisting of:

A. a solid composition consisting essentially of:

a. an encapsulated bicarbonate;

e. about 1 to 25% active by weight anionic surfactant;

f. an acid selected from the group consisting of citric acid, malic acid, adipic acid and oxalic acid;

g. an encapsulated fragrance;

h. optionally, one or more of the following ingredients: foam boosters, abrasives, antimicrobial agents, hydrotropes, solvents, polymers, rheology control agents, chelating agents, colorants, anticorrosion agents and any combinations or mixtures thereof; and B. a water soluble polymer film shaped into said pouch which contains said solid composition.

20. A water soluble pouch for cleaning a garbage disposal consisting of:

A. a solid composition comprising:

a. greater than 25% to about 55% active weight of encapsulated bicarbonate;

b. about 5 to 25% active weight of surfactant;

c. an acid selected from the group consisting of citric acid, malic acid, adipic acid and oxalic acid;

d. an encapsulated fragrance; and

B. a water soluble polymer film shaped into said pouch which contains said solid composition.

* * * * *